United States Patent [19]

Katabe et al.

[11] 4,144,178

[45] Mar. 13, 1979

[54] COMPOSITION FOR LUBRICATING TREATMENT OF SYNTHETIC FIBERS

[75] Inventors: Kenichi Katabe; Takeshi Hirota, both of Wakayama, Japan

[73] Assignee: Kao Soap Co., Ltd., Tokyo, Japan

[21] Appl. No.: 925,865

[22] Filed: Jul. 18, 1978

[30] Foreign Application Priority Data

Aug. 12, 1977 [JP] Japan ..... 52-97130

[51] Int. Cl.[2] ..... D06M 13/10

[52] U.S. Cl. ..... 252/8.9; 8/115.6; 252/8.6

[58] Field of Search ..... 252/8.9, 8.6; 8/115.6

[56] References Cited

U.S. PATENT DOCUMENTS

| | | | |
|---|---|---|---|
| 3,039,895 | 6/1962 | Yuk | 252/8.6 |
| 3,518,184 | 6/1970 | Potter | 252/8.9 |
| 3,997,450 | 12/1976 | Steinmiller | 252/8.9 |
| 4,019,990 | 4/1977 | Marshall et al. | 252/8.9 |
| 4,044,033 | 8/1977 | Fusco | 252/8.8 |
| 4,094,797 | 6/1978 | Newkirk et al. | 252/8.9 |

*Primary Examiner*—William E. Schulz

*Attorney, Agent, or Firm*—Blanchard, Flynn, Thiel, Boutell & Tanis

[57] ABSTRACT

A composition for lubricating synthetic fibers, which comprises (i) a base oil containing compounds of the formula (I):

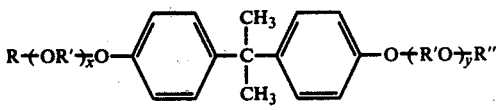

(I)

wherein R and R'' each are hydrogen or acyl having 1 to 22 carbon atoms, R' is alkylene having 2 to 4 carbon atoms, and x and y each is an integer of at least 1, with the proviso that the sum of x and y does not exceed 50, and at least one ester selected from the group consisting of esters of aliphatic monohydric alcohols with monobasic fatty acids, dibasic fatty acids or mixture thereof and esters of aliphatic polyhydric alcohols with monobasic fatty acids, said ester having a kinematic viscosity not higher than 70 centistokes measured at 30° C., and (ii) a polymer of 2,2,4-trimethyl-1,2-dihydroquinoline.

17 Claims, No Drawings

COMPOSITION FOR LUBRICATING TREATMENT OF SYNTHETIC FIBERS

BACKGROUND OF THE INVENTION

1. FIELD OF THE INVENTION

The present invention relates to a composition for the lubricating treatment of synthetic fibers. More particularly, the invention relates to a composition for the lubricating treatment of synthetic fibers which are to be subjected to a subsequent heating process, which composition has an appropriate lubricating effect and possesses thermal stability at high temperatures.

2. DESCRIPTION OF THE PRIOR ART

In the manufacture of synthetic fibers, filaments prepared by the melt-spinning process are heated for drawing or are subjected to heat setting to improve the properties thereof. Further, in the manufacture of bulky yarns, such as false twisted yarns, a heat treatment is ordinarily conducted for setting the bulky configuration. In these processes, the filaments or yarns are often treated at considerably high speeds. Accordingly, the lubricating compositions applied to filaments or yarns to facilitate such steps as spinning, drawing and processing smoothly are required to have high heat resistance, high lubricity and high antistatic property.

As lubricating agents for complying with the foregoing requirements and suitable for use in combination with an emulsifier, an antistatic agent or the like, there have heretofore been employed mineral oils, esters of higher alcohols with higher fatty acids, esters of higher alcohols with dibasic acids such as adipic acid and sebacic acid or other fatty acids, and esters of trimethylolpropane, ethylene glycol or the like with fatty acids.

These conventional lubricating agents, however, are insufficient in heat resistance. Accordingly, they generate smoke during the heat drawing process or false twisting step whereby to form tar-like substances on the heaters, and therefore, the passages for yarn are considerably contaminated which in turn causes such troubles as monofilament winding or yarn breakage. As a result, it becomes impossible to perform the drawing or false twisting operation smoothly and the machine has to be stopped for cleaning. Thus, various troubles are caused and the operational efficiency is reduced.

As means for preventing the formation of tar-like substances on heaters, there has been proposed a method in which a specific polyalkylene glycol is incorporated as a lubricating component (see, for example, Japanese Patent Publication No. 50657/72, Japanese Patent Application Laid-Open Specification No. 22793/73 and Japanese Patent Publication No. 33793/73).

Such specific polyalkylene glycol has the preferred property that no tar-like substance is formed when it is heated on a heater. However, it is readily oxidized and decomposed by heat or light so as to generate a bad smell or it is defective because it deteriorates with the passing of time. Further, compounds of this type do not have a sufficient affinity with hydrophobic fibers such as nylon fibers and polyester fibers. Accordingly, in the manufacture of fibrous products for which a high strength is required, such as tire cords, hoses, belts and fishing nets, lubricating agents of this type are insufficient in their capacity of protecting filaments and yarns from severe heating and friction.

Our assignee previously developed compounds for a lubricating composition for synthetic fibers intended to be treated by a heating process, which compounds have excellent heat stability, and disclosed these compounds in Japanese Patent Publication No. 29474/72 and Japanese Patent Application Laid-Open Specification No. 70397/76.

The lubricating agents used in these prior inventions are diesters formed by adding an alkylene oxide to bisphenol A and esterifying the adduct with a higher fatty acid or the like. These diesters have the formulas (II) or (III):

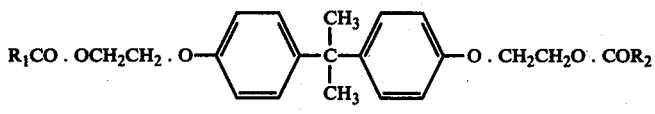

(II)

or

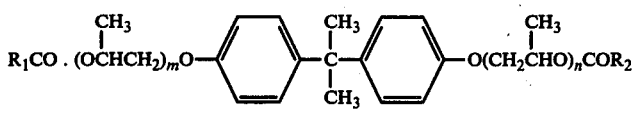

(III)

wherein $R_1$ and $R_2$ each is a saturated or unsaturated hydrocarbon group having 8 to 22 carbon atoms, and m and n each are integers of at least 1, with the proviso that the sum of m and n does not exceed 50.

Lubricating compositions containing these compounds have a very excellent heat stability, and the foregoing defects involved in the conventional lubricating compositions were eliminated by using these compounds.

However, it has been found that these compounds are disadvantageous because the friction of fibers, especially with metals or porcelains, is very high and the lubricity is insufficient. Accordingly, the lubricity should be improved for some uses.

It may be supposed that the lubricity will probably be improved by mixing an ester formed by reaction between a monohydric or polyhydric alcohol and a monobasic or dibasic fatty acid with a compound of the formula (II) or (III) (hereinafter referred to as "bisphenol type ester" or "bisphenol type lubricant"). It has been found that the smoothness can be improved by this modification, but the heat resistance is drastically degraded.

It is, therefore, a primary object of the present invention to provide a composition for the lubricating treatment of synthetic fibers in which the foregoing defects are eliminated or ameliorated, namely, a lubricating composition for synthetic fibers in which the generation of smoke and the formation of tar-like substances are remarkably controlled and which has an excellent heat stability and imparts good lubricity to synthetic fibers.

SUMMARY OF THE INVENTION

We have discovered that when a small amount of a specific compound is incorporated in a lubricating composition comprising a compound having the above formula (II) or (III), the foregoing object can be effectively attained.

More specifically, in accordance with the fundamental aspect of the present invention, there is provided a composition for lubricating synthetic fibers, which comprises (i) a base oil containing compounds of the formula (I):

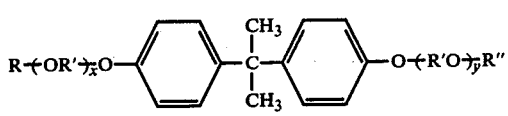

(I)

wherein R and R″ each are hydrogen or acyl group having 1 to 22 carbon atoms, R′ is alkylene having 2 to 4 carbon atoms, and x and y each is an integer of at least 1, with the proviso that the sum of x and y does not exceed 50, and at least one ester selected from the group consisting of esters of aliphatic monohydric alcohols with monobasic fatty acids, dibasic fatty acids or mixture thereof, and esters of aliphatic polyhydric alcohols with monobasic fatty acids, said ester having a kinematic viscosity not higher than 70 centistokes measured at 30° C., and (ii) a polymer of 2,2,4-trimethyl-1,2-dihydroquinoline.

In accordance with the present invention, there is also provided a composition for the lubricating treatment of synthetic fibers as set forth above, which further comprises an alkali metal compound.

The polymer of 2,2,4-trimethyl-1,2-dihydroquinoline that is used in the present invention is a compound having the following formula, in which the degree of polymerization, namely, the value of n, is preferably in the range of from 2 to 5:

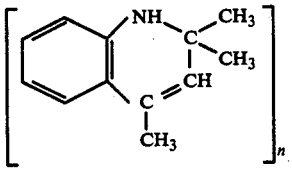

Polymers of this type are marketed under trademarks "Antigene RD" (Sumitomo Kagaku), "Antage RD" (Kawaguchi Kagaku) and "Noclarck 224" (Ouchi Shinko Kagaku), and they are commercially available.

The polymer is incorporated in an amount of from 0.05 to 5.0% by weight, preferably 0.1 to 5.0% by weight, based on the total weight of a composition consisting essentially of a compound of the formula (I), an ester-type lubricating agent having a kinematic viscosity of not higher than 70 centistokes at 30° C., as described above, and an emulsifier and an antistatic agent. Incorporation of the polymer in an amount exceeding 5.0% by weight is not preferred from the economical viewpoint. When the amount incorporated of the polymer is smaller than 0.05% by weight, the intended effect of the present invention cannot be attained.

In the present invention, the heat stability of the composition can be further improved by adding an alkali metal compound in combination with the polymer of 2,2,4-trimethyl-1,2-dihydroquinoline. Substantially all organic and inorganic compounds containing an alkali metal can be used in the present invention. As specific examples, there can be mentioned hydroxides such as sodium hydroxide and potassium hydroxide, salts such as lithium carbonate, sodium carbonate and potassium chloride, alkali metal salts of organic acids such as acetic acid, citric acid, succinic acid, maleic acid, phthalic acid, capric acid, lauric acid, oleic acid and resinolic acid, potassium salts of lauryl phosphate and POE lauryl phosphate, and potassium salts of lauryl sulfate and POE lauryl sulfate. Among them, potassium compounds are most effective, and the effect is reduced in the order of sodium compounds and lithium compounds. The amount incorporated of the alkali metal compound is from 0.05 to 25% by weight, preferably 0.1 to 25% by weight, based on the total weight of a composition containing the polymer of 2,4,4-trimethyl-1,2-dihydroquinoline in the amount described above and consisting essentially of a compound of the formula (I), an ester-type lubricant having a kinematic viscosity of not higher than 70 centistokes measured at 30° C., as described above, and an emulsifier and an antistatic agent.

The ester-type lubricant having a kinematic viscosity of not higher than 70 centistokes measured at 30° C., that is used in the present invention, includes esters of monohydric alcohols and monobasic fatty acids, such as butyl stearate, butyl oleate, 2-ethylhexyl stearate, lauryl oleate and oleyl oleate, esters of monohydric alcohols and dibasic fatty acids such as dioctyl sebacate, di-2-ethylhexyl adipate, di-isodecyl adipate and dioleyl sebacate, and esters of polyhydric alcohols and monobasic fatty acids such as ethylene glycol dioleate, trimethylolpropane tricaprylate, pentaerythritol mono-oleate, glycerin trioleate, 1,6-hexanediol dioleate, 1,4-butanediol dilaurate and polypropylene glycol (200) dimyristate. As the lubricant of aliphatic ester type, there may be also animal and vegetable oils which have a kinetic viscosity of not higher than 70 centistokes measured at 30° C., especially coconat oil, soybean oil, cotton seed oil and safflower oil.

The above-mentioned aliphatic ester-type lubricant that is used in the present invention has a kinematic viscosity of not higher than 70 centistokes, preferably not higher than 50 centistokes, measured at 30° C. When the kinematic viscosity is higher than 70 centistokes, the friction is too high and the intended object of the present invention cannot be attained. The amount of this aliphatic ester-type lubricating agent is not less than 20% by weight, preferably not less than 30% by weight, based on the combined weights of the lubricating components in the treating composition. The lubricating components consist essentially of this aliphatic ester-type lubricating agent and the above-mentioned bisphenol type lubricating agent of formula (I). The amount of the aliphatic ester-type lubricating agent should not be larger than 80% by weight based on the combined weights of the lubricating components. If the amount of the aliphatic ester-type lubricating agent is less than 20% by weight, the friction is not sufficiently lowered and the lubricity is not sufficiently improved. When the amount of the aliphatic ester-type lubricating agent is larger than 80% by weight, the heat resistance is adversely affected.

It is preferred that an emulsifier be incorporated in the lubricating composition of the present invention, although it is not a critical component. As specific examples of emulsifiers, there can be mentioned ethylene oxide adducts of higher alcohols, polyethylene glycol esters of higher fatty acids, polyoxyethylene sorbitan alkyl esters and polyoxyethylene adducts of caster oil. An amount of the emulsifier to be used is in the range of from zero to 50 percent by weight, preferably from 20 to 50 percent by weight. In this case, the composition according to the invention may be used in the form of emulsion in water. As the antistatic agent that can be used in the present invention, there can be mentioned anionic antistatic agents such as alkyl phosphate ester salts, alkyl sulfonate salts and alkali metal salts of fatty acids, amphoteric antistatic agents such as alkyl iminopropionate salts and alkyl betaine salts, and cationic antistatic agents such as trialkyl ammonium chlorides.

The lubricating composition of the present invention, which has been described hereinbefore, is ordinarily supplied to filaments and yarns in the form of a water-free or aqueous emulsion by the roller supply technique or the like. Synthetic fibers treated with the composition of the present invention have an excellent lubricity and do not generate smoke or produce tar-like substances during the heat treating step.

The present invention will now be further described in detail by reference to the following illustrative Examples.

EXAMPLE 1

Conventional lubricating compositions Nos. 1, 2, 3, 4 and 5 are shown in Table 1, and the effects attained by the incorporation of the third component of the present invention, i.e., a polymer (average degree n of polymerization = 3) of 2,2,4-trimethyl-1,2-dihydroquinoline, are shown in Table 2.

Table 1

| Composition No. | Components | Mixing Ratio (% by weight) |
|---|---|---|
| 1 | bisphenol type lubricant A | 60 |
| | polyoxyethylene hydrogenated castor oil ester ($\bar{p}$ = 25) | 40 |
| 2 | bisphenol type lubricant A | 5 |
| | hexamethylene glycol dioleate (viscosity = 37.5 centistokes) | 55 |
| | polyoxyethylene hydrogenated castor oil ester ($\bar{p}$ = 25) | 40 |
| 3 | bisphenol type lubricant A | 40 |
| | oleyl oleate (viscosity = 23.8 centistokes) | 20 |
| | polyoxyethylene hydrogenated castor oil ester ($\bar{p}$ = 25) | 40 |
| 4 | bisphenol type lubricant A | 24 |
| | hexamethylene glycol dioleate (viscosity = 37.5 centistokes) | 36 |
| | polyoxyethylene hydrogenated castor oil ester ($\bar{p}$ = 25) | 40 |
| 5 | bisphenol type lubricant A | 45 |
| | trimethylolethane tricaprylate (viscosity = 32.5 centistokes) | 15 |
| | polyoxyethylene hydrogenated castor oil ester ($\bar{p}$ = 25) | 40 |

Table 1-continued

In Table 1, the lubricant A is a compound of the formula (I) in which each of R and R'' is acyl having 12 carbon atoms, R' is alkylene having 2 carbon atoms, i.e., ethylene, and each of x and y is 1. The kinematic viscosity is the value measured at 30° C., and $\bar{p}$ designates an average number of moles of added ethylene oxide.

Table 2

| Composition No. | Amount (%) of Added Polymer of 2,2,4-Trimethyl-1,2-Dihydroquinoline | Heat Resistance: Heating Loss (%) | Heat Resistance: Tar Forming Ratio (%) | Lubricity: Secondary Tension (g) |
|---|---|---|---|---|
| 1-1(Comparison) | 0.00 | 33.0 | 0.2 | >200 |
| 1-2(Comparison) | 1.00 | 31.5 | 0.1 | >200 |
| 2-1(Comparison) | 0.00 | 58.7 | 36.8 | 110 |
| 2-2(Comparison) | 0.03 | 55.5 | 35.2 | 105 |
| 2-3(Comparison) | 1.00 | 39.8 | 25.0 | 113 |
| 3-1(Comparison) | 0.00 | 61.8 | 37.3 | 150 |
| 3-2(Invention) | 0.05 | 61.5 | 7.8 | 152 |
| 3-3(Invention) | 1.00 | 45.3 | 2.5 | 160 |
| 4-1(Invention) | 0.00 | 52.3 | 36.0 | 130 |
| 4-2(Invention) | 1.00 | 35.1 | 0.2 | 128 |
| 4-3(Invention) | 2.00 | 34.1 | 0.2 | 135 |
| 5-1(Comparison) | 0.00 | 59.9 | 34.8 | 175 |
| 5-2(Invention) | 0.1 | 49.0 | 2.4 | 180 |
| 5-3(Invention) | 1.0 | 38.5 | 0.5 | 177 |

The heating loss, tar forming ratio and secondary tension were determined according to the following methods.

(1) Heating Loss and Tar Forming Ratio:

In a commercially available aluminum saucer, about 0.5 g of a sample was placed, and the sample was heated at 250° C. for 5 hours. The weight of the sample remaining after the heating was precisely measured, and the heating loss was calculated according to the following formula:

$$\text{Heating Loss (\%)} = \frac{\text{(weight before heating)} - \text{(weight after heating)}}{\text{weight of sample before heating}} \times 100$$

After the measurement of the heating loss, the aluminum saucer was washed with acetone, and after drying, the weight of the substance left on the saucer was precisely measured. In general, the residual substance insoluble in acetone was a black resinous substance. A larger amount of this residual substance indicates a higher tar forming ratio. The value of the tar forming ratio was calculated according to the following formula:

$$\text{Tar Forming Ratio (\%)} = \frac{\text{weight of acetone insoluble residue}}{\text{weight of sample}} \times 100$$

(2) Lubricity:

A lubricating composition was applied in an amount of about 1% by weight to commercially available nylon 6 filamentary yarn, and the secondary tension of the yarn was measured under the conditions of an initial tension of 15 g, a friction pin-yarn contact angle of 180° and a yarn speed of 150 m/min by using a measurement apparatus manufactured by Eiko Sokki K.K. A smaller value of the secondary tension indicates a better lubricity.

As will be apparent from the results shown in Tables 1 and 2, the lubricating composition free of the aliphatic ester-type lubricating agent of the present invention having a kinematic viscosity not higher than 70 centistokes measured at 30° C. (composition No. 1) has a good heat resistance but in inferior in lubricity. The lubricating composition containing the aliphatic ester-type lubricating agent in an amount outside the range specified in the present invention has an improved smoothness but the heat resistance is degraded. In the case of the lubricating agent containing the aliphatic ester-type lubricating agent in an amount within the range specified in the present invention, the smoothness can be improved, but if the third component of the present invention, i.e., a polymer of 2,2,4-trimethyl-1,2-dihydroquinoline, is not incorporated in an amount in the range specified in the present invention, the heat resistance is drastically degraded. Thus, it will readily be understood that a composition comprising the bisphenol type lubricating agent, the aliphatic ester having a kinematic viscosity not higher than 70 centistokes measured at 30° C. and the polymer of 2,2,4-trimethyl-1,2-dihydroquinoline has excellent heat resistance and lubricity.

EXAMPLE 2

Conventional lubricating compositions Nos. 6, 7, 8, 9 and 10 are shown in Table 3, and results of the measurements of the heat resistance and lubricity obtained when a polymer (average polymerization degree n = about 2) of 2,2,4-trimethyl-1,2-dihydroquinoline was added as the third component are shown in Table 4. The heat resistance and smoothness were determined according to the same methods as described in Example 1.

Table 3

| Composition No. | Components | Mixing Ratio (% by weight) |
|---|---|---|
| 6 | bisphenol type lubricant B | 60 |
| | polyoxyethylene hydrogenated castor oil (p = 25) | 40 |
| 7 | bisphenol type lubricant B | 30 |
| | butyl stearate (viscosity = 9.0 centistokes) | 30 |
| | polyoxyethylene hydrogenated castor oil ester (p = 25) | 40 |
| 8 | bisphenol type lubricant B | 5 |
| | dioleyl adipate (viscosity = 41.0 centistokes) | 55 |
| | polyoxyethylene hydrogenated castor oil ester (p = 25) | 40 |
| 9 | bisphenol type lubricant B | 30 |
| | dipentaerythritol hexacaprate (viscosity = 99.7 centistokes) | 30 |
| | polyoxyethylene hydrogenated castor oil ester (p = 25) | 40 |
| 10 | bisphenol type lubricant C | 20 |
| | glycerin dioleate (viscosity = 68.8 centistokes) | 40 |
| | polyoxyethylene hydrogenated castor oil ester (p = 25) | 40 |

The lubricant B is a compound of the above formula (I) in which each of R and R″ is an unsaturated acyl group having 18 carbon atoms, R′ is alkylene having 3 carbon atoms, i.e., propylene, and the sum of x and y is 16. The lubricant C is a compound of the above formula (I) wherein R and R″ each are hydrogen, R′ is a mixed alkylene containing ethylene and propylene at an ethylene/propylene molar ratio of 5/16, the sum of x and y is 21, and $\overline{p}$ is as defined in Example 1.

Table 4

| Composition No. | Amount (%) of Added Polymer of 2,2,4-Trimethyl-1,2-Dihydroquinoline | Heat Resistance: Heating Loss (%) | Heat Resistance: Tar Forming Ratio (%) | Lubricity: Secondary Tension (g) |
|---|---|---|---|---|
| 6-1(Comparison) | 0.00 | 36.1 | 0.1 | >200 |
| 7-1(Comparison) | 0.00 | 67.8 | 31.9 | 121 |
| 7-2(Comparison) | 0.04 | 55.7 | 39.5 | 118 |
| 7-3(Invention) | 0.50 | 53.3 | 18.5 | 109 |
| 7-4(Invention) | 1.00 | 48.1 | 9.5 | 118 |
| 7-5(Invention) | 4.00 | 45.3 | 5.2 | 124 |
| 8-1(Comparison) | 0.00 | 59.8 | 38.5 | 111 |
| 8-2(Comparison) | 1.00 | 41.0 | 28.9 | 113 |
| 9-1(Comparison) | 0.00 | 31.5 | 35.9 | >200 |
| 9-2(Comparison) | 1.00 | 29.5 | 5.3 | >200 |
| 10-1(Comparison) | 0.00 | 32.3 | 36.2 | 193 |
| 10-2(Invention) | 1.00 | 30.8 | 2.5 | 188 |
| 10-3(Invention) | 3.00 | 31.1 | 1.1 | 190 |

As will be apparent from the foregoing results, the lubricating agent containing an aliphatic ester-type lubricating agent having a kinematic viscosity higher than 70 centistokes measured at 30° C. and containing the polymer as the third component in an amount in the range specified in the present invention (composition No. 9-2) has an excellent heat resistance but the lubricity is much inferior. When the amount of the aliphatic ester-type lubricating agent exceeds the range specified in the present invention (composition No. 8-2), no substantial effect can be attained by the addition of the polymer of 2,2,4-trimethyl-1,2-dihydroquinoline as the third component. Thus, it will readily be understood that a lubricating composition containing the bisphenol-type lubricating agent and the aliphatic ester-type lubricating agent in specific amounts and including the above polymer as the third component possesses the combination of properties of excellent heat resistance and good smoothness.

EXAMPLE 3

Conventional lubricating compositions Nos. 11, 12, 13 and 14 are shown in Table 5, and the effects attained by adding a polymer of 2,2,4-trimethyl-1,2-dihydroquinoline as the third component and an alkali metal compound according to the present invention are shown in Table 6.

Table 5

| Composition No. | Components | Mixing Ratio (% by weight) |
|---|---|---|
| 11 | bisphenol type lubricant A | 48 |
| | hexamethylene glycol dioleate (viscosity = 37.5 centistokes) | 12 |
| | polyoxyethylene hydrogenated castor oil ester (p = 25) | 40 |
| 12 | bisphenol type lubricant A | 36 |
| | hexamethylene glycol dioleate (viscosity = 37.5 centistokes) | 24 |
| | polyoxyethylene hydrogenated castor oil ester (p = 25) | 40 |
| 13 | bisphenol type lubricant A | 24 |
| | hexamethylene glycol dioleate (viscosity = 37.5 centistokes) | 36 |
| | polyoxyethylene hydrogenated castor oil ester (p = 25) | 40 |
| 14 | bisphenol type lubricant A | 12 |
| | hexamethylene glycol dioleate (viscosity = 37.5 centistokes) | 48 |
| | polyoxyethylene hydrogenated castor oil ester (p = 25) | 40 |

The bisphenol type lubricant A is the same as the lubricant used in Example 1.

Table 6

| Composition No. | Amount (%) of added Polymer of 2,2,4-Trimethyl-1,2-Dihydroquinoline | Alkali Metal Compound | | Heat Resistance | | Smoothness |
|---|---|---|---|---|---|---|
| | | Kind | Amount % (by weight) | Heating Loss (%) | Tar Forming Ratio (%) | Secondary Tension (g) |
| 11-1 (Invention) | 2.0 | potassium carbonate | 1.0 | 47.0 | 0.2 | 180 |
| 11-2 (Invention) | 2.0 | potassium oleate | 2.0 | 44.1 | 0.0 | 180 |
| 12 (Invention) | 1.0 | potassium oleate | 2.0 | 52.2 | 0.2 | 152 |
| 13-1 (Invention) | 2.0 | potassium acetate | 1.0 | 46.5 | 0.2 | 130 |
| 13-2 (invention) | 2.0 | potassium carbonate | 1.0 | 50.3 | 0.4 | 135 |
| 14-1 (Invention) | 2.0 | potassium acetate | 0.05 | 55.5 | 7.5 | 115 |
| 14-2 (Invention) | 2.0 | potassium acetate | 1.0 | 41.1 | 0.2 | 107 |

In this Example, the heat resistance test was conducted at 250° C. for 8 hours. Other test conditions were the same as those described in Example 1.

From Tables 5 and 6, it will be apparent that a fiber-lubricating composition containing a polymer of 2,2,4-trimethyl-1,2-dihydroquinoline as the third component and an alkali metal compound according to the present invention has not only an improved smoothness but also an excellent heat resistance.

EXAMPLE 4

A conventional lubricating composition No. 15 as shown below was mixed with the third component of this invention, a polymer of 2,2,4-trimethyl-1,2-dihydroquinone and the effects were tested. The measurement was effected in the same manner as in Example 1, except that the heating time was 12 hours.

Table 7

| Composition No. | Components | Mixing ratio (weight percent) |
|---|---|---|
| 15 | bisphenol type lubricant A | 30 |

Table 7-continued

| Composition No. | Components | Mixing ratio (weight percent) |
|---|---|---|
| | coconut oil (having a viscosity of 42.5 centistokes at 30° C) | 30 |
| | polyoxyethylene hydrogenated castor oil ester (p = 10) | 30 |
| | polyoxyethylene stearylamine | 5 |
| | potassium polyoxyethylene (p = 3) lauryl sesquiphosphate | 5 |

Table 8

| Composition No. | Amount (%) added polymer of 2,2,4-trimethyl-1,2-dihydroquinoline | Heat Resistance | | Lubricity |
|---|---|---|---|---|
| | | Heating Loss (%) | Tar Forming Ratio (%) | Secondary Tension (g) |
| 15-1 (Comparison) | 0.00 | 64.5 | 20.9 | 114 |
| 15-2 (Invention) | 2.00 | 41.8 | 0.0 | 116 |

The embodiments of the invention in which an exclusive property or privilege is claimed are defined as follows:

1. A composition for lubricating synthetic fibers, which comprises (i) a base oil containing (a) one or a mixture of two or more compounds of the formula (I):

(I)

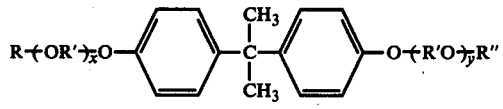

wherein R and R" each are hydrogen or acyl having 1 to 22 carbon atoms, R' is alkylene having 2 to 4 carbon atoms, and x and y each is an integer of at least 1, with the proviso that the sum of x and y does not exceed 50, and (b) one or a mixture of two or more esters selected from the group consisting of esters of aliphatic monohydric alcohols with monobasic fatty acids, dibasic fatty acids or mixture thereof and esters of aliphatic polyhydric alcohols with monobasic fatty acids, said ester having a kinematic viscosity not higher than 70 centistokes measured at 30° C., and (ii) a polymer of 2,2,4-trimethyl-1,2-dihydroquinoline.

2. A composition as set forth in claim 1, wherein the average degree of polymerization of the polymer of 2,2,4-trimethyl-1,2-dihydroquinoline is in the range of from 2 to 5.

3. A composition as set forth in claim 2, wherein the amount of said polymer is from 0.05 to 5.0% by weight, based on the total weight of the composition.

4. A composition as set forth in claim 1, wherein R and R'' each are acyl having 12 to 18 carbon atoms, R' is ethylene, and the sum of x and y is in the range of from 2 to 25.

5. A composition as set forth in claim 1, wherein said ester is selected from the group consisting of 1,6-hexanediol dioleate, 1,4-butanediol dilaurate, dioleyl adipate, trimethylolpropane trioleate, glycerin trilaurate, glycerin trioleate, soybean oil, cotton seed oil and safflower oil.

6. A composition as claimed in claim 1 which further contains an alkali metal compound.

7. A composition as set forth in claim 6, wherein the average degree of polymerization of said polymer is in the range of from 2 to 5.

8. A composition as set forth in claim 7, wherein the amount of said polymer is 0.05 to 5.0% by weight, based on the total weight of the composition and the amount of said alkali metal compound is from 0.1 to 25% by weight, based on the total weight of the composition.

9. A composition as set forth in claim 8, wherein the alkali metal compound is an alkali metal hydroxide, an alkali metal salt of an inorganic acid or an alkali metal salt of an organic acid.

10. A composition as set forth in claim 9, wherein the alkali metal compound is potassium hydroxide, a potassium salt of an inorganic acid or a potassium salt of an organic acid.

11. A composition as set forth in claim 6, wherein R and R'' each is acyl having 12 to 18 carbon atoms, R' is ethylene, and the sum of x and y is in the range of from 2 to 25.

12. A composition as set forth in claim 6, wherein the ester is selected from the group consisting of 1,6-hexanediol dioleate, 1,4-butanediol dilaurate, dioleyl adipate, trimethylolpropane trioleate, glycerin trilaurate, glycerin trioleate, soybean oil, cotton seed oil and safflower oil.

13. A composition according to claim 1 in which the amount of (b) is from 20 to 80% by weight, based on the sum of the weights of (a) plus (b), said polymer (ii) has an average degree of polymerization in the range of from 2 to 5 and the amount of said polymer is from 0.05 to 5.0% by weight, based on the total weight of the composition.

14. A composition according to claim 13, in which said monohydric alcohol is an aliphatic hydrocarbon monohydric alcohol having from 4 to 18 carbon atoms, said monobasic acid is an aliphatic hydrocarbon monocarboxylic fatty acid having from 10 to 22 carbon atoms, said dibasic acid is an aliphatic hydrocarbon dicarboxylic fatty acid having from 6 to 10 carbon atoms and said polyhydric alcohol is an aliphatic hydrocarbon polyhydric alcohol having from 2 to 10 carbon atoms.

15. A composition according to claim 13 in which said ester is selected from the group consisting of butyl stearate, butyl oleate, 2-ethylhexyl stearate, lauryl oleate, oleyl oleate, dioctyl sebacate, di-2-ethylhexyl adipate, dioleyl adipate, di-isodecyl adipate, dioleyl sebacate, ethylene glycol dioleate, trimethylolethane tricaprylate, trimethylolpropane tricaprylate, pentaerythritol mono-oleate, glycerin trioleate, glycerin dioleate, 1,6-hexanediol dioleate, 1,4-butanediol dilaurate and propylene glycol dimyristate.

16. A composition according to claim 13 consisting essentially of (i) and (ii).

17. A composition according to claim 13 consisting essentially of (i), (ii) and an emulsifier selected from the group consisting of ethylene oxide adducts of higher alcohols, polyethylene glycol esters of higher fatty acids, polyoxyethylene sorbitan alkyl esters and polyoxyethylene adducts of castor oil.

* * * * *